United States Patent [19]

Zigman

[11] Patent Number: 4,576,290

[45] Date of Patent: Mar. 18, 1986

[54] GRIP HANGER

[76] Inventor: Donald J. Zigman, 5569 S. 116th St., Hales Corners, Wis. 53130

[21] Appl. No.: 579,194

[22] Filed: Feb. 10, 1984

[51] Int. Cl.[4] ..... A47F 5/01; A47F 7/08

[52] U.S. Cl. ..... 211/34; 211/119; 248/316.5; 248/316.6

[58] Field of Search ..... 211/34, 119, 38, 116, 211/113; 248/316.5, 316.6, 316.7, 317, 305, 309.1; 24/566, 567, 343, 530

[56] References Cited

U.S. PATENT DOCUMENTS

| | | | |
|---|---|---|---|
| 97,081 | 11/1869 | Griswold | 248/317 |
| 2,284,552 | 5/1942 | Arenz | 211/35 |
| 2,641,366 | 6/1953 | Burch | 211/38 |
| 2,787,379 | 4/1957 | Fritz et al. | 211/38 |
| 2,812,066 | 11/1957 | Volosin | 211/34 |
| 2,969,151 | 1/1961 | Krstulovich | 211/34 |
| 3,317,054 | 5/1967 | Gies | 211/34 |
| 3,802,572 | 4/1974 | Shackel | 211/38 |

FOREIGN PATENT DOCUMENTS

| | | | |
|---|---|---|---|
| 231226 | 3/1944 | Switzerland | 211/34 |

OTHER PUBLICATIONS

The "Post", Delta Arms Sporting Goods of Indianola, Miss.

"Hardy's Solution" Dunn's of Tenn.

*Primary Examiner*—Robert W. Gibson, Jr.

[57] ABSTRACT

An improved apparatus to grasp, grip, securely hold and hang footwear in an inverted position. It consists of a hook, a yoke (in one embodiment) and an attached torsion spring or springs configured to produce a pair of grippers that grasp the heel or sole of footwear.

1 Claim, 2 Drawing Figures

GRIP HANGER

FIELD OF THE INVENTION

This invention relates to footwear hangers and specifically to an improved apparatus that employs one configured torsion spring or two configured torsion springs for hanging footwear in an inverted position.

Discussion of Prior Art

Heretofore, footwear hangers consisted of cloth, wood and/or wire racks, wood or wire posts, a dual purpose wrap-around-the-heel device, wire "U" and wire "S" forms. There is no evidence in the prior art of a footwear hanger that utilizes a configured torsion spring apparatus as a means to hang footwear in an inverted position.

The cloth, wood and wire racks were generally limited to shoes and slippers and did not appear to anticipate accommodating the wide range of modern sports footwear.

The posts which are inserted into the footwear, with or without heating elements, are generally limited to boots (e.g., wadders, hip boots) and are not conveniently portable.

The dual purpose garment and boot hanger (Burch, U.S. Pat. No. 2,641,366, 1949) employs flat and coil spring elements and appears cumbersome to use.

The wire "U" and "S" forms are generally limited to large footwear (e.g., wadders, hip boots). Those devices loosely grasp the footwear at approximately the ankle and are marginally successful in gripping and securely holding the intended objects. Additionally, these latter devices, their use and points of contact with footwear could induce creasing and deterioration of rubber footwear and marring of leather footwear when used for extended periods of time.

OBJECTS

Accordingly the several objects of my invention by reason of its torsion spring elements are: (1) To easily and effectively grasp, grip, securely hold and hang footwear in an inverted position for carrying, storing or display purposes. (2) To be effectively used with most classes of footwear since the width of the gripping elements are adjustable and the grippers can be fitted with molded material to match the contours of the heel or sole of footwear. (3) To be easy to use. (4) To be readily portable. (5) To be inexpensive to manufacture and market.

Further object of my invention will become apparent from a consideration of the drawings and ensuing description thereof.

DRAWINGS

In the accompanying drawings,

FIG. 1 is a perspective view illustrating the grip hanger with two configured torsion springs joined with a yoke and hook to produce a pair of grippers.

FIG. 2 is a perspective view illustrating the grip hanger constructed with one configured torsion spring, with added appendages, joined to a hook to produce a pair of grippers.

DESCRIPTION

Figure 1:
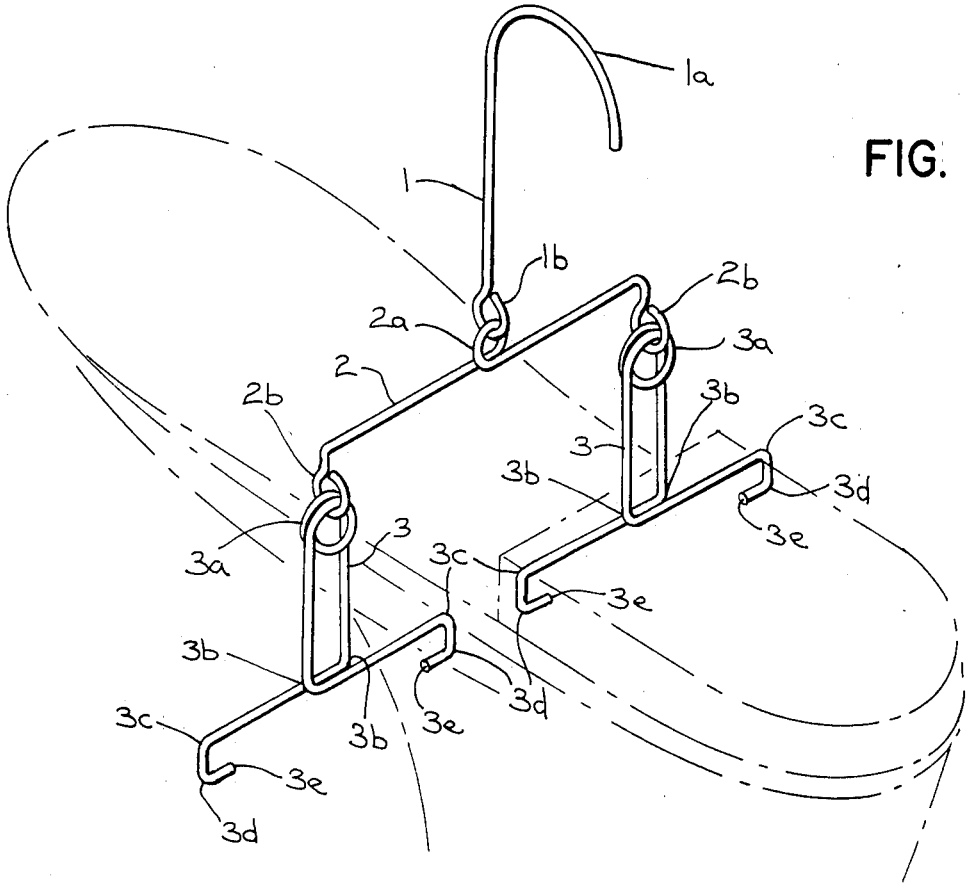
FIGS. 1 and 2 show the grip hanger in use and illustrate the two preferred embodiments. The numerals and letters are repeated in both drawings and are used to refer to like elements where they occur in both drawings.

With reference to FIG. 1, the hook (1) is a wire formed to produce a hook at one end (1*a*) and an eye at the other end (1*b*). The yoke (2) is a wire formed to produce an eye at its center or balance point (2*a*) and eyes at each end (2*b*). The configured torsion spring legs (3) are bent inward on the same plane as the coil (3*a*) and at approximately right angles (3*b*) so that the legs cross on approximately the same plane and project in opposite directions. The legs are further bent downward and inward at right angles (3*c* and *d*) and on approximately the same plane to produce two grippers at the end of the torsion spring legs (3*e*). The two configured torsion springs (3) are joined to the yoke (2) at the eyes (2*b*) and the yoke (2) is joined to the hook (1) at the eye (1*b*).

Figure 2:
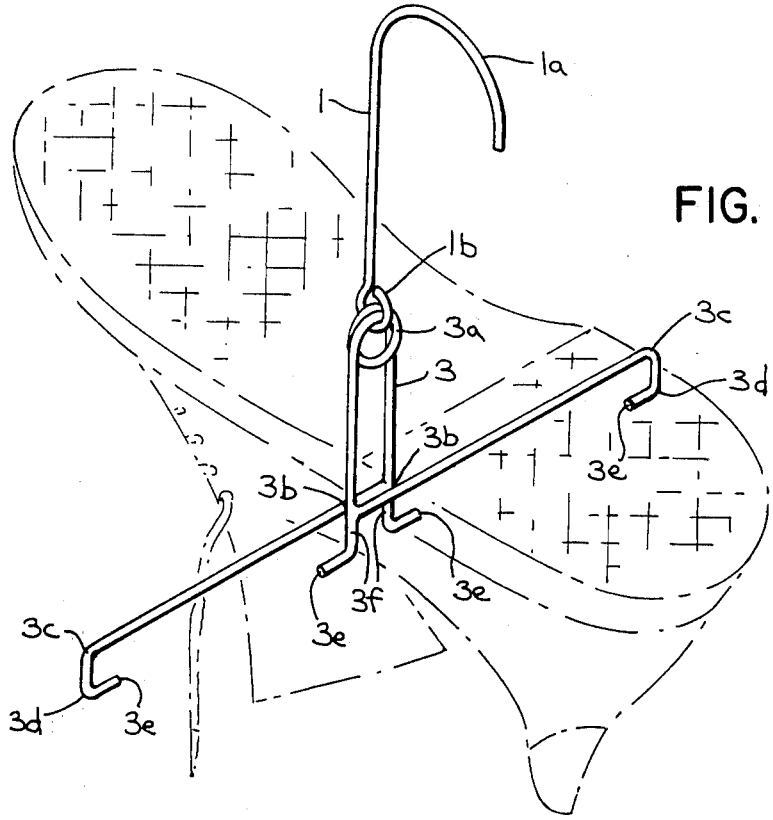

FIG. 2 illustrates a second embodiment of the grip hanger in which the hook eye (1*b*) is joined directly to the coil (3*a*). Appendages (3*f*) are attached to the opposing torsion spring legs, configured as described above for FIG. 1, at the first bend and approximately on the same plane to each other and the coil to produce two added grippers.

In both Figures the four grippers (3*e*) and the configuration of the torsion spring(s) combine to produce a pair of grippers with approximately equal gripping pressure sufficient to securely grip and hold footwear.

OPERATION

Users of my invention place their hand around the legs of the torsion spring between the coil and the first bend in the legs. Squeezing the legs at this point widens the distance between the pair of grippers. Footwear, with the arches facing outward is placed between the grippers, either at the heel or a convenient point in the sole and the squeezing is relaxed whic permits the grippers to grasp the footwear. To release the footwear the legs of the torsion spring are again squeezed and the footwear removed.

BROADENING PARAGRAPH

While the above description contains many specificities these should not be construed a limitation on the scope of my invention, but rather as exemplification of two preferred embodiments thereof. Many variations are possible, for example:

A. The hook could be formed with almost any suitable rigid material (e.g., plastic, wood) to improve comfort in carrying, effectiveness in hanging and appearance.

B. The hook could be joined to the configured torsion spring or yoke and yoke to the configured torsion springs with a swivel or chain to improve flexibility.

C. The legs, between the coil and the first bend, could be fitted with molded finger grips to improve handling.

D. The entire apparatus could be coated or plated with plastic or other suitable material to improve its appearance and prevent rust.

E. The entire apparatus could be made of plastic or other suitable material with the torsion spring embedded at the top of the legs.

F. The grippers could be fitted with contoured molds to match the side contour of the heel or sole of footwear to be gripped.

G. The contoured molded grippers could be removable and replaceable to accommodate a change in footwear storage requirements.

Accordingly, the scope of my invention should be determined not by the embodiments illustrated, but by the appended claims and their legal equivalents.

I claim:

1. A single-coil hanger for suspending footwear in an inverted position, comprising:

a hook having a lower end formed as an eye;

a torsion spring having a coil at its upper end which is received by the eye at the lower end of the hook and having a first leg and a second leg which extend downwardly from the coil;

wherein each of said first and second legs is formed inwardly toward the other leg to cross the other leg in approximately the same horizontal plane and each leg is formed downwardly and inwardly and terminates in a first end gripper and a second end gripper, respectively; and an appendage extends downwardly from each of the first and second legs, said appendage extending downwardly from the first leg being formed toward the second end gripper and terminating in a third end gripper facing the second end gripper and said appendage extending downwardly from the second leg being formed toward the first end gripper and terminating in a fourth end gripper facing the first end gripper so that one article of footwear can be clamped between the first and fourth end grippers and another article of footwear can be clamped between the second and third end grippers.

* * * * *